US007665987B2

(12) United States Patent
Leclerc et al.

(10) Patent No.: US 7,665,987 B2
(45) Date of Patent: Feb. 23, 2010

(54) GAS BURNER FOR OVEN

(75) Inventors: Christophe Leclerc, Poligny (FR); Gilbert Cornu, Buvilly Cedex (FR); Dominique Michaud, La Marre (FR)

(73) Assignee: Thirode Grandes Cuisines Poligny, Poligny (FR)

( * ) Notice: Subject to any disclaimer, the term of this patent is extended or adjusted under 35 U.S.C. 154(b) by 153 days.

(21) Appl. No.: 11/784,169

(22) Filed: Apr. 6, 2007

(65) Prior Publication Data

US 2008/0318174 A1 Dec. 25, 2008

(30) Foreign Application Priority Data

Apr. 14, 2006 (FR) ..... 06 03332

(51) Int. Cl.
*F23D 14/14* (2006.01)
*F23D 3/40* (2006.01)
*F23D 14/12* (2006.01)
*F23D 14/02* (2006.01)

(52) U.S. Cl. ..... 431/329; 431/326; 431/328; 431/7

(58) Field of Classification Search ..... 431/7, 431/8, 10, 114, 127, 129, 157, 158, 202, 431/278–285, 326–329, 347–349, 350, 353, 431/354; 126/91 A, 512; *F23D 14/14*
See application file for complete search history.

(56) References Cited

U.S. PATENT DOCUMENTS 1,606,390 A * 11/1926 Schmuck ..... 432/222
2,201,385 A * 5/1940 Woodson ..... 431/75
2,424,765 A * 7/1947 McCollum ..... 126/116 R
3,188,366 A * 6/1965 Flynn ..... 432/9
3,213,919 A * 10/1965 Calzolari ..... 239/488

(Continued)

FOREIGN PATENT DOCUMENTS

JP 62062111 A * 3/1987

(Continued)

OTHER PUBLICATIONS

Merriam-Webster's Online Dictionary, retrieved Apr. 14, 2009, from http://www.merriam-webster.com/dictionary/mesh.

(Continued)

*Primary Examiner*—Steven B McAllister
*Assistant Examiner*—Daniel E Namay
(74) *Attorney, Agent, or Firm*—Meyertons, Hood, Kivlin, Kowert & Goetzel, P.C.; Eric B. Meyertons

(57) ABSTRACT

Burner for gas oven comprising a device for retaining a flame of the burner, separating the flame from a mixing chamber capable of receiving a flow of primary air and gas to form a gaseous mixture. The flame retention device is provided with a mesh comprising metal threads, capable of allowing said gaseous mixture to pass through the mesh, said mesh comprising at least one main zone and a pilot zone which are adjacent. The pilot zone having, according to a main direction of the flame of the burner, a thickness greater than the thickness of the main zone, capable of slowing down the gaseous mixture passing through the pilot zone relative to the mixture passing through the main zone. The burner comprises at least one orifice capable of receiving a secondary air flow.

16 Claims, 3 Drawing Sheets

U.S. PATENT DOCUMENTS

| | | | | | |
|---|---|---|---|---|---|
| 4,231,735 | A | * | 11/1980 | Downs | 431/328 |
| 4,541,796 | A | * | 9/1985 | Anderson | 431/187 |
| 5,066,219 | A | * | 11/1991 | Anzawa et al. | 431/10 |
| 5,098,284 | A | * | 3/1992 | van der Veen | 431/346 |
| 5,431,557 | A | * | 7/1995 | Hamos | 431/7 |
| 5,810,577 | A | * | 9/1998 | Ledjeff | 431/170 |
| 5,839,890 | A | * | 11/1998 | Snyder | 431/8 |
| 6,056,538 | A | * | 5/2000 | Buchner et al. | 431/115 |
| 6,679,061 | B2 | * | 1/2004 | Steinbach et al. | 60/777 |
| 6,761,558 | B1 | * | 7/2004 | Kim | 431/4 |
| 6,896,512 | B2 | * | 5/2005 | Rattner et al. | 431/328 |
| 7,094,049 | B2 | * | 8/2006 | Mizuno et al. | 431/350 |
| 7,214,055 | B2 | * | 5/2007 | Meister et al. | 431/349 |
| 2004/0033455 | A1 | * | 2/2004 | Tonkovich et al. | 431/7 |
| 2004/0048211 | A1 | * | 3/2004 | Martin et al. | 431/7 |
| 2005/0092314 | A1 | * | 5/2005 | Rabas et al. | 126/21 A |

FOREIGN PATENT DOCUMENTS

| | | | | |
|---|---|---|---|---|
| JP | 06159633 | A | * | 6/1994 |

OTHER PUBLICATIONS

Prabir Basu, Kefa Cen, Louis Jestin, Boilers and Burners: Design and Theory, 2000, p. 212.

* cited by examiner

GAS BURNER FOR OVEN

BACKGROUND OF THE INVENTION

1. Field of the Invention

The invention generally relates to heating systems for ovens, particularly gas heating systems.

2. Description of the Relevant Art

In the field of gas burners for ovens, the ovens are used in large commercial or institutional kitchens.

The energy produced by the combustion is recovered in thermal form. The products of the gas combustion pass through, for example, heat exchanger tubes where they are cooled to remove the thermal energy therefrom. Apart from possible pressure losses in the heat exchanger tubes or in chimney flues, the combustion gases from the burner are substantially at atmospheric pressure. The mechanical energy of the combustion gases from the burner is a drawback, causing vibrations and noise in the oven.

A gas cooker fitted with hollow heating elements passed through by combustion products from a gas burner is known. One drawback of this type of burner is the limited thermal power. More specifically, when the flow of the mixture of air and inflammable gas increases, the propagation speed of the combustion of the flame in the gas mixture flow may be lower than the speed of the flow of the mixture and the flame blows off the burner. If the phenomenon is not rapidly corrected, the flame is blown out and extinguished. Conversely, if the gas mixture flow is lower than the propagation of the flame, said flame may go upstream of the burner. A further drawback of this type of oven is that under the effect of the thermal variations and the mechanical effects of the combustion gas flow, the heating elements, brought to a high temperature, may start to vibrate. This causes an unpleasant noise and reduces the lifespan of the oven.

A flame retention plate is known for a gas burner. This plate plays the role of a distribution screen for the gas mixture streams. It comprises a compressed network of interwoven threads. This structure allows gas streams to pass in a substantially evenly distributed manner over the entire surface of the plate and a uniform distribution of the flame produced. However, this type of burner has the drawback of being restricted in the thermal output per $cm^2$ of the retention plate. Moreover, this type of burner aims to produce flames of relatively low height and where the thermal output is localised close to the retention plate. It is apparent that this type of burner is suitable for heating, from the outside, water coils for domestic boilers, for example. For ovens, it is desirable to heat the heat exchanger tubes from the inside. It is desirable to distribute the flame to reduce hot spots.

A flame retention device is known, comprising several identical rings composed of a compressed network of interwoven metal threads. The gas mixture passes through the rings in a radial manner. Each of the rings produces a radial circular flame. The rings are coaxial and superposed over one another and separated by solid crosspieces, which are not passed through by the gas mixture. The external diameter of the solid crosspieces is less than the external diameter of the rings of the compressed network. Pilot flames are formed in the grooves corresponding to the crosspieces. The aforementioned drawback, namely that of increasing thermal energy solely at the point of the retention plate of the burner, is accentuated here, as the combustion gases are propagated radially relative to the axis of the burner.

A burner provided with porous tubular body elements is known. The wall of the tube is made of a compressed network of threads. A plurality of tubular shapes are axially nested in one another to form a burner of larger dimensions. The stabilisation of the flame is improved by a deflector plate. In this type of burner, the thermal energy is released radially relative to the axis of the burner.

A burner head has been disclosed where a sealed combustion chamber opens into a plurality of heat exchanger tubes passed through by the combustion gases. A housing surrounding the combustion chamber brings fresh air to the heat exchanger tube inlet to reduce the temperature of the transition between the combustion chamber and the heat exchanger tubes. In this type of burner, the air contributing to the combustion of the inflammable gas is entirely contained in the gas mixture upstream of the combustion chamber. The combustion products are discharged through heat exchanger tubes by an outlet manifold. The drawback with this type of burner is that, for limiting the combustion products which are not oxidised by combustion, it is necessary to introduce into the gas mixture, which passes through the burner, excess air relative to the stoichiometric proportions of the gas. For a given thermal output of the burner, the over-supply of air may cause a detachment of the flame. Even if the detachment of the flame is limited, however, the over-supply of air reduces the thermal output of the flame.

A need exists for a burner for a gas oven which alleviates the aforementioned drawbacks and, in particular, which allows the thermal energy of the burner to be increased, by avoiding the detachment of the flame and by distributing said flame.

SUMMARY OF THE INVENTION

According to one embodiment, the burner for the gas oven comprises a device for retaining the flame of the burner, separating a flame from a mixing chamber capable of receiving a flow of primary air and gas to form a gaseous mixture. The flame retention device is provided with a mesh comprising metal threads, capable of allowing said gaseous mixture to pass through the mesh, said mesh comprising at least one main zone and a pilot zone which are adjacent. The pilot zone has, according to a main direction of the flame of the burner, a thickness greater than the thickness of the main zone, capable of slowing down the gaseous mixture passing through the pilot zone relative to the mixture passing through the main zone. The burner comprises at least one orifice capable of receiving a secondary air flow.

It is conceivable that, in such a burner, the fact that one mesh zone, known as the "pilot zone" is thicker in the direction of the flame of the burner, means that the gaseous mixture streams passing through the pilot zone are slowed down over a path passing through the mesh and are of greater length than those passing through the main zone. The streams passing through the pilot zone have a lower speed than those passing through the main zone and are able to supply a small flame known as the "pilot flame" which is not at risk of blowing off said pilot zone. The flow of gaseous mixture in the main zone may be increased. The pilot flame initiates the commencement of combustion of the gas streams leaving the main zone. The thermal output of the burner is increased. This increase in output is accompanied by an increase in the length of the flame but not in its temperature. This may allow the occurrence of hot spots to be avoided.

According to an embodiment, the main zone of the mesh has a porosity level of between 60% and 90%.

According to an embodiment, the main zone of the compressed mesh has a thickness of between 3 and 8 mm.

According to an embodiment, the thickness ratio of the pilot zone to the main zone is between 2 and 5.

According to an embodiment, the burner comprises a means for guiding the secondary air flow towards the flame. It is conceivable that, in this further embodiment, the secondary air flow allows the combustion residues from the mixing chamber to be combusted. The flow of mixed gases may be increased, for example, up to the stoichiometric proportion of the primary air flow, with a low risk of detaching the flame. The thermal output of the burner is increased and the flame increases in temperature. The secondary air flow also makes it possible to regulate the flow of combustion products, in particular for controlling the conditions for igniting and increasing the size of the flame, the quality of the combustion and the functional reliability, irrespective of the optimal rate of air supply for combustion, selected for the mixing chamber of the burner.

According to an embodiment, the flame retention device comprises a principal disc perpendicular to the direction of the flame of the burner and a coaxial pilot ring, superposed on the periphery and downstream of the principal disc. The ring and the disc each comprises a mesh of metal threads.

According to an embodiment, the orifice capable of receiving the secondary air flow is located on the periphery of the flame retention device.

The two possibilities for increasing the thermal output of the burner due to the pilot zone and to the secondary air flow may be combined. This embodiment has an additional advantage due to the fact that the pilot ring aids the separation of the secondary air flow and the flame leaving the main zone. This separation prevents the secondary air from blowing out the flame. Moreover, fresh air arrives at the periphery of the flame. This avoids having a hot spot at the point of the flame retention device. This also contributes to the lengthening of the flame. Moreover, the pilot zone and the main zone are adjacent and the pilot zone is further downstream than the main zone. These two characteristics have the effect that a portion of the streams leaving the pilot zone may be combined, at reduced speed, with the streams leaving the main zone. This may allow a flow transition of the mixture between the main zone at a high flow rate and the pilot zone.

According to an embodiment, the burner comprises a sealed housing connected to a fan and surrounding the mixing chamber in addition to the secondary air orifice(s). The fan is connected, on the inside of the housing, to the mixing chamber by a bypass connecting means capable of introducing the primary air flow into the mixing chamber and deflecting the secondary air flow towards the housing.

According to an embodiment, the metal threads of the mesh are arranged to form, according to the direction of the flame, a series of deflecting obstacles capable of deflecting the path of a stream of the gaseous flow. This has the advantage that the gaseous mixture streams are distributed substantially uniformly over the entire surface of the mesh. Moreover, the numerous deflecting obstacles locally reduce the passage section of the gas streams. This increases locally the speed of the gas streams and prevents the flame from going back upstream of the mesh.

According to an embodiment, the mixing chamber is provided with a static suction device intended to be passed through by a primary air flow and capable of sucking up the inflammable gas.

According to an embodiment, the burner for the gas oven comprises a retention device for a flame of the burner separating the flame from a gas mixing chamber. The flame retention device is provided with a mesh in the compressed state comprising metal threads, capable of allowing said gaseous mixture to pass through the mesh. The mesh comprises at least one main zone and a pilot zone which are adjacent. The pilot zone has, according to the direction of the flame of the burner, a greater thickness than the thickness of the main zone.

According to a further embodiment, the burner for the gas oven comprises a device for retaining a flame of the burner separating the flame of a mixing chamber capable of receiving a flow of primary air and gas. The burner comprises at least one orifice capable of receiving a secondary air flow, and a means for guiding the secondary air flow towards the flame.

According to an embodiment, an oven is fitted with a burner in which the flame of the burner is located in a combustion pipe, extended by at least one heat exchanger tube capable of conducting the combustion gases; the oven comprising a fan for cooking air and means for guiding the cooking air from the fan to the heat exchanger tube(s) and a cooking zone for the oven.

BRIEF DESCRIPTION OF THE DRAWINGS

Further features and advantages will become apparent from reading the detailed description of several embodiments taken by way of non-limiting example and illustrated by the accompanying drawings, in which.

Figure 1:
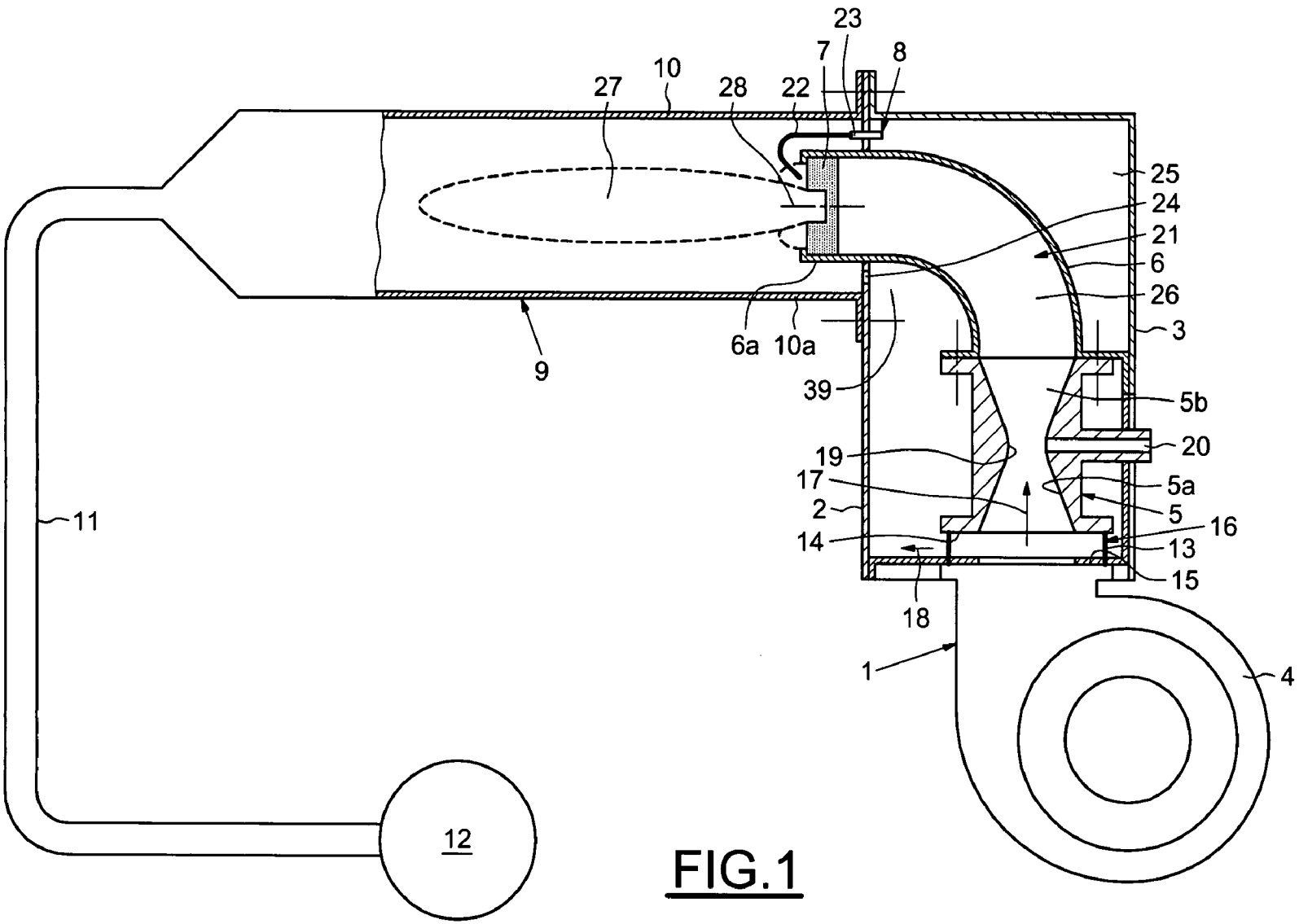
FIG. 1 is a schematic sectional view of a burner.

While the invention may be susceptible to various modifications and alternative forms, specific embodiments thereof are shown by way of example in the drawings and will herein be described in detail. The drawings may not be to scale. It should be understood, however, that the drawings and detailed description thereto are not intended to limit the invention to the particular form disclosed, but to the contrary, the intention is to cover all modifications, equivalents, and alternatives falling within the spirit and scope of the present invention as defined by the appended claims.

DETAILED DESCRIPTION OF THE PREFERRED EMBODIMENTS

As illustrated in FIG. 1, a burner comprises a propulsive assembly 1 fixed to a fixing plate 2 and surrounded by a box 3. The propulsive assembly 1 comprises a fan 4, a venturi device 5, an upstream sleeve 6 and a retention device 7 for a flame 27. The fixing plate 2 also receives an ignition device 8 and a heat exchanger assembly 9. The heat exchanger assembly 9 successively comprises a combustion pipe 10 fixed to the fixing plate 2, at least one heat exchanger tube 11 and an outlet 12.

The fan 4 is of the centrifugal type and pushes the sucked-up air through the venturi device 5. The venturi device 5 is fixed rigidly opposite, and at a distance from, the outlet orifice of the fan 4. The bypass connecting device 16 comprises crosspieces 13, for example in the form of small pillars or washers which are pushed between an inlet plate 14 of the venturi device 4 and an outlet plate 15 of the fan 4. The mechanical connection between the venturi device 5 and the fan 4 is rigid but not sealed. The air from the fan 4 is divided between a primary flow 17 and a secondary flow 18.

The venturi device 5 has an axial cavity in the form of two opposing truncated cones, passed through by the primary flow 17. The variation of the cross section of the cavity is gradual and continuous and has a restricted diameter 19 located between an upstream part 5*a* and a downstream part 5*b*. The progressive expansion of the primary air flow 17 in the downstream part 5*b* of the venturi device causes low pressure on the wall of the cavity. A transverse channel 20 discharges into the cavity at the point where the primary flow 17 is at low pressure. The venturi device 5 is a static suction device capable of sucking up the inflammable gas through the transverse channel 20 connected to a gas supply.

The space defined by the downstream part 5*b* of the venturi device 5, the upstream sleeve 6 and the flame retention device 7 constitutes a mixing chamber 21. The connection of the venturi device 5 and the upstream sleeve 6 is sealed. The primary air flow 17 is mixed with the gas from the transverse channel 20 to form a gaseous mixture 26 which flows through the mixing chamber 21, passes through the retention device 7, and is then ignited by the ignition device 8.

The ignition device 8 may be formed by a central conductor 22 and an insulating sleeve 23 surrounding the central conductor 22 and fixed onto the fixing plate 2 and is of the incandescent or spark type.

A plurality of peripheral orifices 24 are formed in the fixing plate 2 around the flame retention device 7 and open out inside the combustion pipe 10. The box 3 surrounds the propulsive assembly 1 and is connected in a sealed manner to the fixing plate 2. The fixing plate 2 and the box 3 together form a sealed housing 25 penetrated by one end 6*a* of the upstream sleeve 6 receiving the retention device 7 through the transverse channel 20, through the outlet of the fan 4 and through the peripheral orifices 24. The secondary air flow 18 escaping from the bypass connecting device 16 is enclosed by the housing 25 and may escape through the peripheral orifices 24. The space separating the inlet plate 14 of the venturi 5 and the outlet plate 15 of the fan 4 is controlled so that the secondary air flow 18, escaping from the bypass connecting device 16, has a pressure greater than atmospheric pressure and greater than the pressure inside the combustion pipe 10. A secondary air flow 39 passes through the peripheral orifices 24 in the direction of the flame 27.

The combustion pipe 10 has an elongate form surrounding the flame retention device 27, the peripheral orifices 24 and the ignition devices 8. The chemical reaction of oxidation of the inflammable gas with the air takes place in the flame 27. The direction of flow of the gaseous mixture 26, downstream of the retention device 7 for the flame 27, defines a principal direction 28 for the flame 27 of the burner.

The chemical reaction transforms the gaseous mixture 26 into combustion products and releases thermal energy. The thermal energy heats the combustion products which enter into contact with the combustion pipe 10 and then flow inside the heat exchanger 11. The heat exchanger assembly 9 is also heated by direct radiation of the thermal energy of the flame 27.

The fact that the orifices 24 are located in the vicinity of the flame 27, allows a reliable and noiseless ignition. More specifically, when the ignition device 8 ignites the gaseous mixture 26, the pressure in the combustion pipe 10 increases suddenly. The orifices 24 contribute to the absorption of the transitory effect of ignition and prevent an explosion noise which is encountered in enclosed heat exchangers on the side of the retention device 7 for the flame 27.

Moreover, the possibility of being able to regulate the secondary air flow 39 allows the flow passing through the heat exchanger assembly 9, and in particular the tube 11, to be regulated. This makes it possible, without modifying the thermal output of the burner, to avoid resonating conditions of the heat exchanger assembly 9 and the noise which results therefrom.

Figure 2:
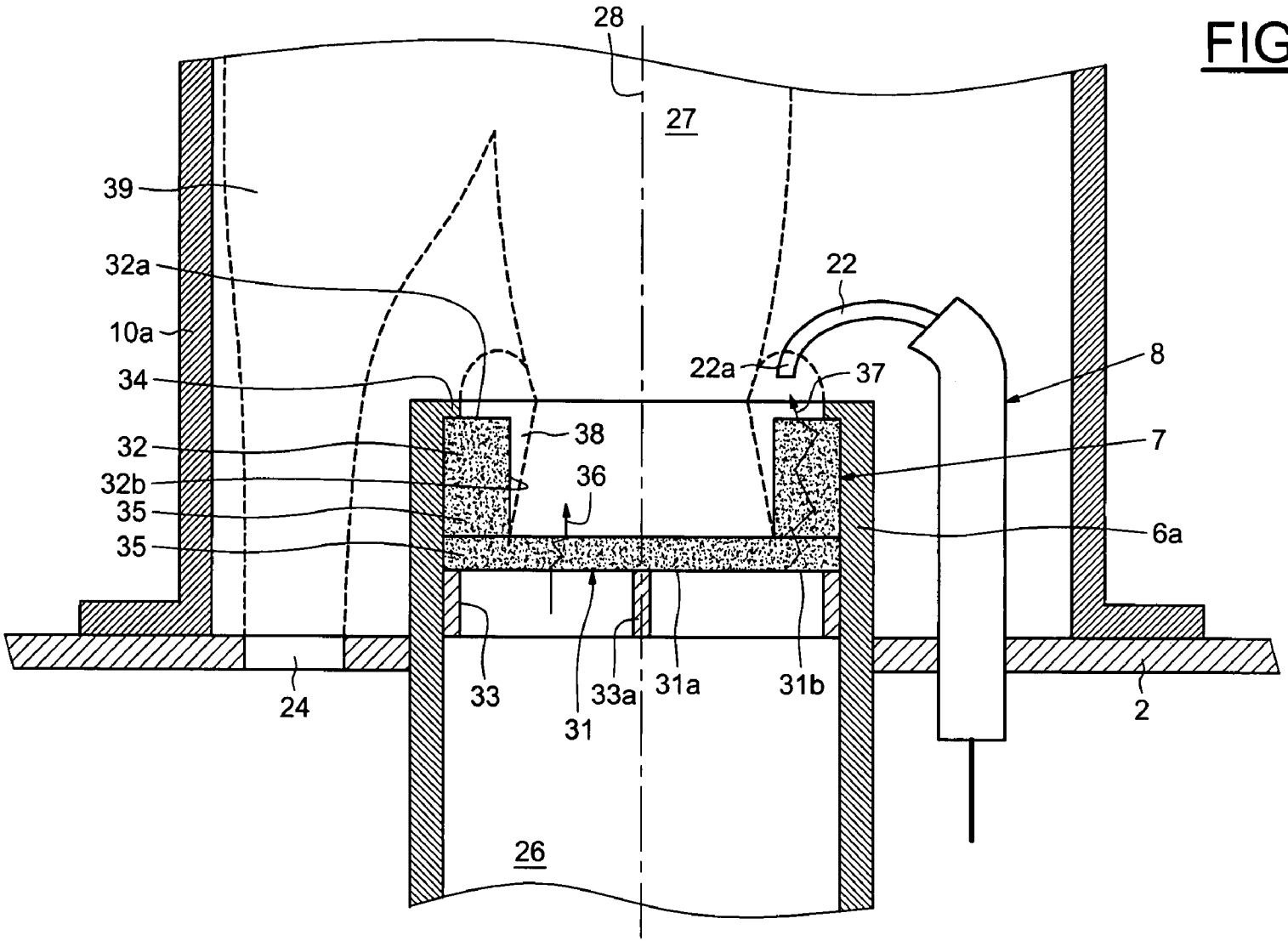
FIG. 2 is a detailed view of the retention device of the burner.

As illustrated in FIG. 2, the retention device 7 for the flame 27 is housed inside the end 6*a* of the sleeve 6 and comprises a principal disc 31 passing through the entire internal cross section of the sleeve 6. A pilot ring 32, coaxial with the principal disc 31, is superposed downstream from the principal disc 31, and is in radial contact with the internal surface of the end 6*a* of the sleeve 6. The principal disc 31 and the pilot ring 32 are both formed by a mesh 35 of metal threads, interwoven or knitted and then compressed. During the compression, the metal threads undergo plastic deformation. The mesh 35 in the free state retains the shape obtained during its compression. The space remaining between the deformed metal threads allows the passage of gaseous mixture streams 26 after numerous deflections. This allows the speeds of the streams passing through the mesh 35 to be harmonised. An embodiment of such meshes is disclosed in the patent application FR 2 708 083, the content of which is incorporated therein by reference.

A ring 33 is provided with ribs 33*a* in the form of cross braces and fixed upstream of the principal disc 31. Lugs 34 extend radially towards the inside of the sleeve 6 and are arranged downstream and on the periphery of the pilot ring 32. The ring 33 and the lugs 34 enclose the principal disc 31 and the pilot ring 32 for holding them mechanically, in spite of the rise in temperature of the retention device 7 for the flame 27 which may reach 1000° C.

The pilot ring 32 may be of rectangular section and has an edge surface 32*a*, downstream and perpendicular to the principal direction 28, in addition to an internal cylindrical surface 32*b*. One end 22*a* of the central conductor 22 of the ignition device 8 is arranged in the immediate vicinity of the edge surface 32*a*. During ignition, a spark shoots from the end 22*a* of the central conductor 22 towards the metal threads 35*a* of the mesh 35 which are connected to the electrical mass.

The principal disc 31 comprises a central part 31*a* and a peripheral part 31*b* above which is superposed the ring 32. The gaseous mixture 26 is divided, passing through the retention device 7 between the central streams 36 passing through the central part 31*a* and the peripheral streams 37 passing through the peripheral part 31*b* and the ring 32. The central streams 36 have a uniform speed of propagation over the entire surface of the central part 31*a*. The peripheral streams 37 are distributed in a retarded propagation area 38 located along the edge surface 32*a* and the internal surface 32*b*.

The surface area of the peripheral part 31*b* is considerably less than the sum of the edge surface 32*a* and the internal surface 32*b*. This enlargement of the surface area and the greater thickness of the mesh 35 to be passed through by the peripheral streams 37 relative to the central streams 36 mean that the speed of the peripheral streams 37 downstream of the pilot ring 32 is considerably reduced relative to the speed of the central streams 36 having passed through the central part 31*a*.

The spark initiates the combustion of the gaseous mixture 37 in said retarded propagation area 38 in which the pilot flame is formed, which initiates in turn the combustion of the central streams 36. The fact that the pilot ring 32 has an internal surface 32*b* extending over a specific axial distance contributes to the efficiency of the pilot flame. The central streams 36 are in contact, over the whole of this axial distance, with the pilot flame to enter into combustion. The speed of propagation of the central streams 36 may be considerably increased without the main flame 27 being blown off. Such an arrangement of the retention device allows the flow of gaseous mixture 26 and the thermal output of the burner to be considerably increased.

The secondary air flow 39 coming from the orifices 24 has a pressure greater than the pressure of the combustion products and constitutes a thermal insulating layer. This limits the rise in temperature of an upstream part 10*a* of the combustion pipe 10 located opposite the end 6*a* of the sleeve 6 and the flame 27. This thermal insulation allows a hot spot of the combustion pipe 10 to be avoided. In particular, the secondary air flow 39 is guided so that the connecting zone between the fixing plate 2 and the burner is maintained at a low temperature. This allows the current seals to be used and the lifespan of the burner assembly to be improved. Moreover, the secondary air 39 provides oxygen to the flame 27 so as to reduce the proportion of unburned gases or partially oxidised oxides, such as carbon monoxide. The fact that the peripheral orifices 24 are located around the flame retention device 27 allows the secondary air 39 to be naturally guided towards the flame 27. The secondary air flow 39 contributes to the stabilisation of the flame 27.

In a particular embodiment, the principal disc 31 is formed by a knitted fabric of metal threads. The metal threads may be made of stainless steel, for example of the 304L type and with a diameter of between 0.1 and 0.4 mm, preferably in the order of 0.2 mm. The disc 31 has an external diameter of between 50 and 70 mm, preferably between 55 and 60 mm, and for example of 57.8 mm. The thickness of the disc 31 is between 3 and 8 mm, preferably in the order of 5 mm.

The ring 32 consists of a knitted fabric of metal threads made of stainless steel, for example of the 309 type and with a diameter thicker than the thread of the principal disc 31, preferably between 0.2 and 0.35 mm, for example in the order of 0.28 mm. The ring 32 has an internal diameter less than the diameter of the principal disc 31, preferably between 35 and 45 mm, for example in the order of 40 mm. The ring 32 has an external diameter which is preferably identical to the diameter of the principal disc 31 and a height of between 5 and 25 mm, preferably between 10 and 20 mm, in particular between two times and five times the thickness of the principal disc 31. The thickness of the ring 32 may be in the order of 15 mm. The mesh 35 formed by the compressed knitted fabric has, for the ring, as for the disc, a porosity of between 60% and 90% of the external volume of the mesh, preferably between 70% and 80% and, for example, of approximately 75%.

The thermal output of the burner may be adjusted over a range of, for example, 8 to 40 kilowatts and, apart from variations in flow, exploiting in particular the chemical composition of the inflammable gas.

Further types of materials could be suitable for the mesh 35 since they have a random series of deflecting obstacles distributed randomly over the entire volume of the mesh 35, so that the gas streams, passing through said material, are deflected and distributed in a uniform manner over the entire surface of the mesh 35.

A retention device 7 for the flame 27 of the burner combining a pilot zone 32 associated with the orifices 24 confers a great versatility to the burner. A single burner may equip a large variety of ovens and accommodate differences in losses in pressure of the heat exchanger 9 according to the size of ovens equipped. The same device 7 with the associated orifices 24 may be used with the different types of gas usually encountered in kitchens. The same device 7, with the associated orifices 24 may equip burners of which the nominal outputs vary over a large range, for example from a single burner to a double burner with the same gas type, or even when changing the type of gas. The fact that the same device 7 with the associated orifices 24 covers a wide range of applications, makes it possible to reduce the costs of production and storage of the individual parts which are required for the after-sales services of sales networks.

Figure 3:
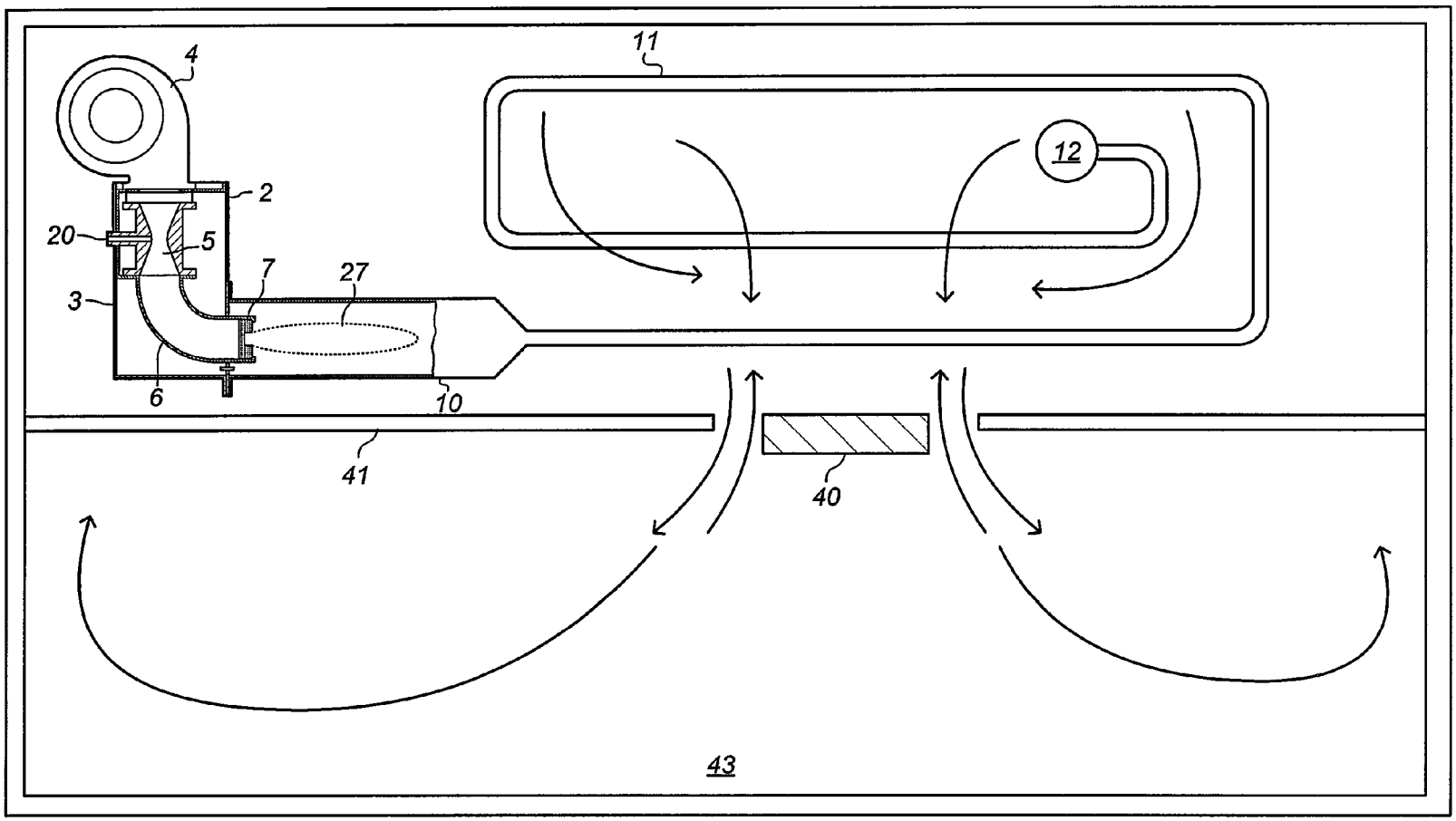
FIG. 3 depicts a sectional view of an embodiment of an oven fitted with the burner.

In the embodiment illustrated by FIG. 3, an oven is fitted with the burner in which the flame 27 of the burner is located in a combustion pipe 10, extended by a heat exchanger tube 11 conducting the combustion gases. According to the embodiment, the oven further includes a fan 40 for cooking air, and members 41 for guiding the cooking air from the fan to the heat exchanger tube 11 and a cooking zone 43 for the oven.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A burner for a gas oven comprising:

a mixing chamber configured to receive a flow of primary air and gas to form a gaseous mixture;

a flame retention device configured to retain a flame of the burner, separating the flame and the mixing chamber, wherein the flame retention device comprises a mesh comprising:

metal threads, configured to allow said gaseous mixture to pass through the mesh, at least one main zone; and a pilot zone adjacent to the at least one main zone, the pilot zone having, according to a main direction of the flame of the burner, a thickness greater than the thickness of the main zone, configured to slow down the gaseous mixture passing through the pilot zone relative to the mixture passing through the main zone; and at least one orifice configured to receive a secondary air flow.

2. The burner according to claim 1, wherein the main zone of the mesh has a porosity level of between 60% and 90% and a thickness of between 3 and 8 mm.

3. The burner according to claim 1, wherein the thickness ratio of the pilot zone to the main zone is between 2 and 5.

4. The burner according to claim 1, further comprising a means for guiding the secondary air flow towards the flame.

5. The burner according to claim 1, wherein the flame retention device comprises a principal disc perpendicular to the direction of the flame of the burner and a coaxial pilot ring, superposed on the periphery and downstream of the principal disc, the ring and the disc each comprising a mesh of metal threads.

6. The burner according to claim 1, wherein the orifice configured to receive the secondary air flow is located on the periphery of the flame retention device.

7. The burner according to claim 1, further comprising a housing connected to a fan and surrounding the mixing chamber in addition to the secondary air orifice(s); the fan being connected on the inside of the housing, to the mixing chamber by a bypass connecting means configured to introduce the primary air flow into the mixing chamber and deflecting the secondary air flow towards the housing.

8. The burner according to claim 7, wherein the bypass connecting means comprises crosspieces pushed between an inlet plate of a venturi device and an outlet plate of the fan, the mechanical connection between the venturi device and the fan being rigid but not sealed, the air from the fan being divided between the primary flow and the secondary flow.

9. The burner according to claim 8, wherein the secondary air flow escaping by means of the bypass connecting means is enclosed by the housing and may escape through peripheral orifices, the space separating the inlet plate of the venturi and the outlet plate of the fan being controlled so that the secondary air flow, escaping from the bypass connecting device, has a pressure greater than atmospheric pressure and greater than the pressure inside a combustion pipe, a secondary air flow passing through the peripheral orifices in the direction of the flame.

10. The burner according to claim 1, wherein the metal threads of the mesh are arranged to form, according to the direction of the flame, a series of deflecting obstacles configured to deflect the path of a stream of the gaseous flow.

11. The burner according to claim 7, wherein the metal threads of the mesh are arranged to form, according to the direction of the flame, a series of deflecting obstacles configured to deflect the path of a stream of the gaseous flow.

12. The burner according to claim 1, wherein the mixing chamber is provided with a static suction device intended to be passed through by a primary air flow and configured to suck up the inflammable gas.

13. A flame burner for a gas oven comprising:

a mixing chamber configured to receive a flow of primary air and gas to form a gaseous mixture;

at least one orifice configured to receive a secondary air flow; and a flame retention device, separating the flame from the mixing chamber, the flame retention device comprising:

a mesh configured to allow said gas mixture to pass though comprising:

metal threads configured to deflect the path of the gas streams;

at least one main zone; and a pilot zone adjacent to the at least one main zone, the pilot zone having, according to a main direction of the flame of the burner, a thickness greater than the thickness of the main zone, configured to reduce the speed of the gaseous mixture passing through the pilot zone to a value lower than the speed of the mixture passing through the main zone.

14. The burner according to claim 2, wherein the thickness ratio of the pilot zone to the main zone is between 2 and 5.

15. The burner according to claim 8, wherein the secondary air flow escaping by means of the bypass connecting means is enclosed by the housing and may escape through peripheral orifices, the space separating the inlet plate of the venturi and the outlet plate of the fan being controlled so that the secondary air flow, escaping from the bypass connecting device, has a pressure greater than atmospheric pressure and greater than the pressure inside a combustion pipe, a secondary air flow passing through the peripheral orifices in the direction of the flame.

16. The burner according to claim 8, wherein the cross-pieces comprise small pillars or washers.

* * * * *

UNITED STATES PATENT AND TRADEMARK OFFICE

CERTIFICATE OF CORRECTION

PATENT NO. : 7,665,987 B2
APPLICATION NO. : 11/784169
DATED : February 23, 2010
INVENTOR(S) : Leclerc et al.

It is certified that error appears in the above-identified patent and that said Letters Patent is hereby corrected as shown below:

In the Claims:

Claim 13, col. 10, line 4, please delete "though" and substitute therefor -- through --.

Signed and Sealed this

Thirteenth Day of April, 2010

David J. Kappos

David J. Kappos
*Director of the United States Patent and Trademark Office*